US006766722B2

(12) United States Patent
Plasswich

(10) Patent No.: US 6,766,722 B2
(45) Date of Patent: Jul. 27, 2004

(54) CUTTING AND TRANSPORT ROLLER WITH INTEGRATED CUTTER WITH ROTATING CUTTING SURFACES

(75) Inventor: Franz Plasswich, Bremen (DE)

(73) Assignee: Windmoeller & Hoelscher, Lengerich (DE)

( * ) Notice: Subject to any disclaimer, the term of this patent is extended or adjusted under 35 U.S.C. 154(b) by 120 days.

(21) Appl. No.: 09/960,729

(22) Filed: Sep. 24, 2001

(65) Prior Publication Data

US 2002/0066347 A1 Jun. 6, 2002

(30) Foreign Application Priority Data

Sep. 22, 2000 (DE) ..... 100 47 545

(51) Int. Cl.[7] ..... B26D 1/56

(52) U.S. Cl. ..... 83/304; 83/337; 83/673; 83/678

(58) Field of Search ..... 83/332, 338, 728, 83/678, 677, 373, 346, 347, 348, 564, 563, 407, 408, 436.4, 163, 343, 300, 303, 318, 337, 673

(56) References Cited

U.S. PATENT DOCUMENTS 2,916,956 A 12/1959 Salomon
3,590,695 A * 7/1971 Gerard ..... 493/363
5,193,425 A * 3/1993 Campbell et al. ..... 83/113
5,282,409 A * 2/1994 Rojas ..... 83/698.31
5,313,863 A * 5/1994 Aihara et al. ..... 83/171
6,026,727 A * 2/2000 Meeks ..... 83/887
6,105,479 A * 8/2000 Neier et al. ..... 83/304
6,553,883 B1 * 4/2003 Adami ..... 83/508.1

FOREIGN PATENT DOCUMENTS

EP 0 698 571 2/1996

* cited by examiner

*Primary Examiner*—Allan N. Shoap
*Assistant Examiner*—Phong Nguyen
(74) *Attorney, Agent, or Firm*—Jacobson Holman PLLC

(57) ABSTRACT

A cutting and transport roller and a process for cutting the material webs which rest on the peripheral surface of the cutting and transport roller. In so doing, the material webs are severed with the aid of a cutter, which is located inside the shell of the cutting and transport roller in its resting position and which exhibits at least one knife, which during the cutting process of the material web reaches through an opening in the shell of the cutting and transport roller. The cutting motion, which is executed by the cutting surfaces of the knife during the cutting process, exhibits rotary components, whereby the rotational motions of the knife run about an axis of rotation, which is either parallel or at an acute angle to a perpendicular line on the plane which is defined by the radial (r) and axial (z) coordinates of the cutting and transport roller.

14 Claims, 7 Drawing Sheets

CUTTING AND TRANSPORT ROLLER WITH INTEGRATED CUTTER WITH ROTATING CUTTING SURFACES

BACKGROUND OF THE INVENTION

1. Field of the Invention

The invention relates to a cutting and transport roller which exhibits an outer shell provided with a slotted opening and containing a cutter for cutting the material webs which rest on the shell of the transport roller. The cutter contains at least one knife, which is guided by a cutter holder and which in turn exhibits at least one cutting edge, the knife being hinged to the cutter holder so as to swivel and reach through the opening in the shell during the cutting process of the material web. The present invention also relates to a process for cutting a material web with the aid of such a roller.

The invention relates to a cutting and transport roller with integrated cutter in accordance with the preamble of claim 1 and a process for cutting a material web with the aid of such a roller.

2. Description of the Related Art

Cutting and transport rollers of the aforementioned kind are known. The EP 0 698 571 A2 shows a cutting and transport roller, which exhibits an outer shell, provided with a slotted opening, and contains a cutter for material webs. Said cutter severs the material webs, resting on the peripheral surface of the transport roller. This cutter exhibits a cutter bar with a knife with a serrated cutting surface.

The cutter bar is hinged to the cutter. During the cutting process of the material webs, resting on the cutting and transport roller, knife and cutter bar execute a translational motion in the radial direction of the cutting and transport roller, whereby at least the knife reaches through the slit in the shell and pierces the film. After the cutting process knife and cutter bar are withdrawn again into the interior of the roller.

Devices of the described type are mechanically complicated, because the forces required to sever the material webs are large. Moreover, after the completed cutting process, knife and cutter bar have to be withdrawn into the interior of the roller, which is rotating in the normal case. In this process the force, generated by the cutter, has to overcome a significant. centrifugal acceleration, which acts on the knife and cutter bar.

The large force, generated by the cutter during the cutting process, is transferred at least partially to the material web and has to be compensated for there, for example, by means of complicated vacuum or suction mechanisms, which are supposed to prevent the material web from being pushed away and then sliding off the roller.

Therefore, the present invention is based on the problem of reducing the mechanical complexity of such a device.

SUMMARY OF THE INVENTION

This problem is solved in that the cutter, integrated into the roller, is assigned at least one knife, which is linked to a knife holder so as to swivel, whereby the swivelable coupling of said at least one knife defines for said at least one cutting edge of the knife an axis of rotation, which runs either parallel or at an acute angle to a perpendicular line on the plane, which is defined by the radial (r) and the axial (z) coordinates of the cutting and transport roller.

Owing to these measures, the cutting blades of at least one knife execute during the cutting process a motion, which includes at least rotary components.

The inventive design of a cutting and transport roller has a number of advantages.

For example, during the cutting motion with exclusively rotary components, only said at least one knife, but not the generally heavy cutter bar is moved.

In addition to the simpler mechanical design of the cutting mechanism, the complexity, caused by the necessity to hold the film on the roller according to the state of the art, is also reduced. In a cutting process, which is carried out exclusively by means of a translation of the knife in the radial direction of the roller, the film is also forced outwards exclusively in the radial direction.

In a device, according to the present invention, the cutting knives can be positioned in such a manner that the film is pushed away from the roller only during the first half of the piercing procedure. During this period, the film is only perforated and not yet completely severed. Therefore, the film is held on the roller largely due to its looping around the roller on both sides of the perforation and due to the still existing web tension.

After the rotational motion of the knife blades in the radial direction has surpassed its apex, the rotational motion of the knife acts radially in the direction of the main axis of symmetry of the roller and, in this manner, counteracts a lifting of the material web from the roller. In light of the centrifugal acceleration which acts on this material web when the roller rotates around its main axis of symmetry, this state is very advantageous.

The described advantages still remain, even when translational motion components are superposed on the rotational motion of the present invention. This requirement can be converted mechanically in the radial direction by means of the motion of the cutter bar.

However, in light of the enormous centrifugal forces owing to the high roller speed generated in the interim, a device according to the present invention can also be advantageously provided with vacuum and suction mechanisms, which prevent the material web from being lifted from the roller especially after the cutting process.

Above all, a device according to the present invention can make do with a plurality of knives with very thin blades. Therefore, in a device of this type, economical industrial knives or knives of ground thin sheet steel can also be used.

In a device with a plurality of knives it is advantageous, if the spacing between the knives is less than or equal to the length of the cut, for the knives to be affixed into the material web during the cutting process.

Another possibility to guarantee a complete, clean severing of the web lies in a translation of the cutter, preferably in the axial direction during the cutting process.

If the cutting process is performed by a plurality of knives, the cutting processes are advantageous, wherein the different knives make contact with the material web at different times. In this manner the force or torque complexity of the cutting process is reduced. Advantageous devices to carry out such a process include, for example, knives of varying lengths or knives suspended from points of rotation and that are positioned so as to be offset in the radial direction of the roller.

Another advantageous method for carrying out the process of the present invention can be performed with the aid of a circular cutter, which can be designed similarly to a circular saw. Such a circular cutter advantageously provides a torque with the aid of an electric motor and consequently puts a substantially circular disk-shaped knife into an inventive rotational motion around its main axis of symmetry. To sever wide material webs cleanly over their entire width, the thin substantially circular knife can be moved in the axial direction of the roller.

Other features and advantages of the invention are disclosed in the other dependent claims and the following description in conjunction with the drawings, in which the embodiments of the invention are depicted as schematic drawings.

DETAILED DESCRIPTION OF THE PREFERRED EMBODIMENT

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
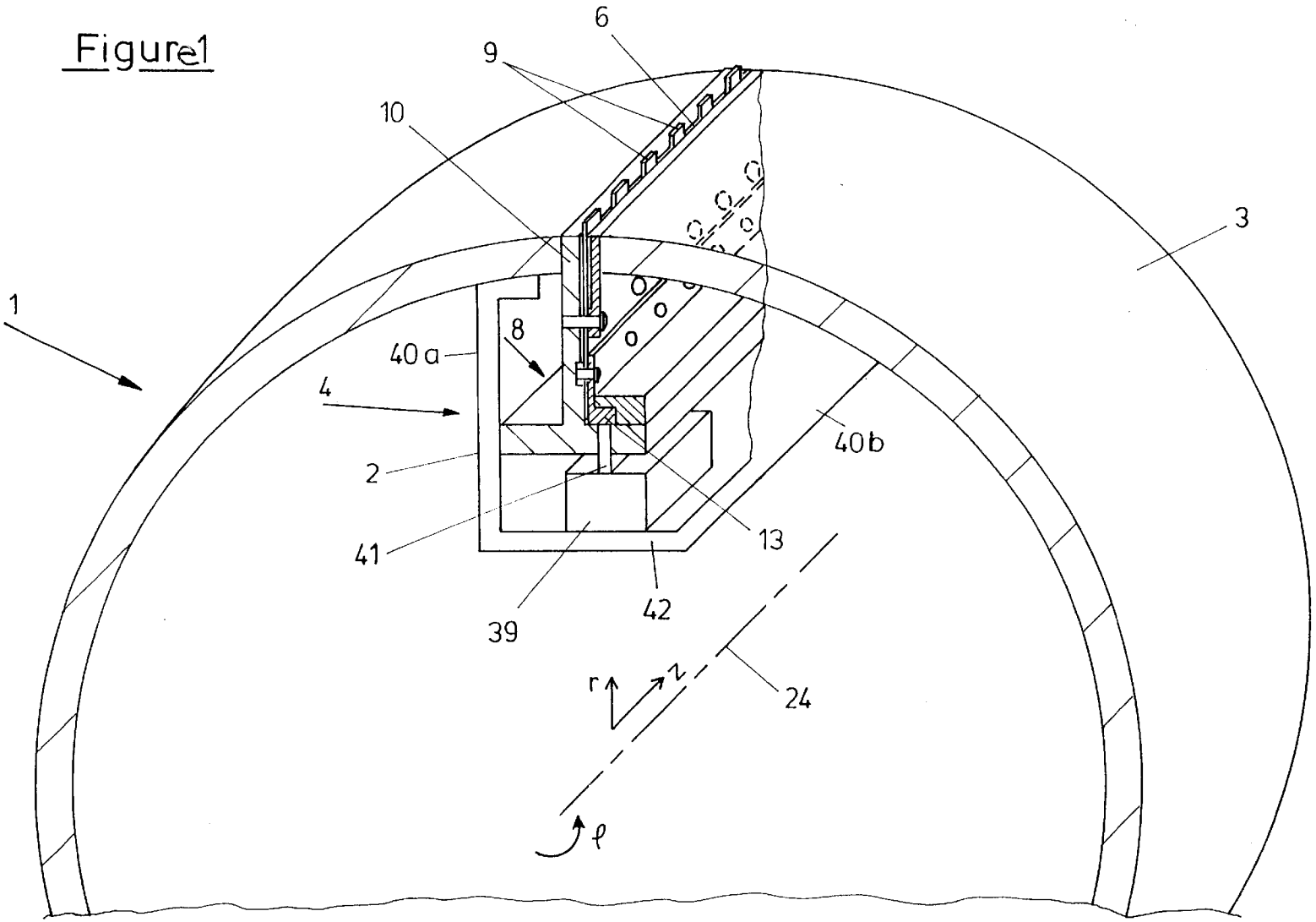
FIG. 1 is a sectional view of a cutting and transport roller.

FIG. 1 is a sectional view of a cutting and transport roller 1, according to the invention. The cutting and transport roller 1 is cut along the plane, defined by the radial and angular coordinates of the roller. Within the shell 3 of the cutting and transport roller 1 there is also the cutter 4 with the knives 9, which in this presentation are reaching through the knife slit 6. The material web 7, which normally rests against the shell 3 and is being cut in this knife position, is not drawn for the sake of a better overview.

The entire cutter 4 is housed in a box 2, which in turn is attached to the inside of the shell 3 of the roller 1.

To permit a view of the interior of the box 2 of the cutter 4 in FIG. 1, the vertical wall 40*b* of the box of the cutter is broken open.

In the illustrated embodiment, the cutter bar comprises in essence a T profile 10. Below the horizontal overhang of the T profile, a pressure cylinder 39 is attached to the floor 42 of the box 2. The pressure cylinder 39, which may be embodied as an ORIGA® pressure cylinder was drawn as a square for reasons relating to the graphical presentation.

The pressure cylinder 39 has a projecting portion or cone 41, which reaches through the slit 43 in the horizontal overhang 11 of the T profile and moves the carriage 13 of the pull-thrust rod 14 during the cutting process. The cone 41 was drawn as a rectangle for reasons relating to the graphical presentation.

Usually the cutting and transport roller rotates during the cutting process around its main axis of symmetry 24. In the rest of the description the invention is presented primarily with reference to the coordinate system of the cylinder of the cutting and transport roller that has already been sketched in FIG. 1.

Figure 2:
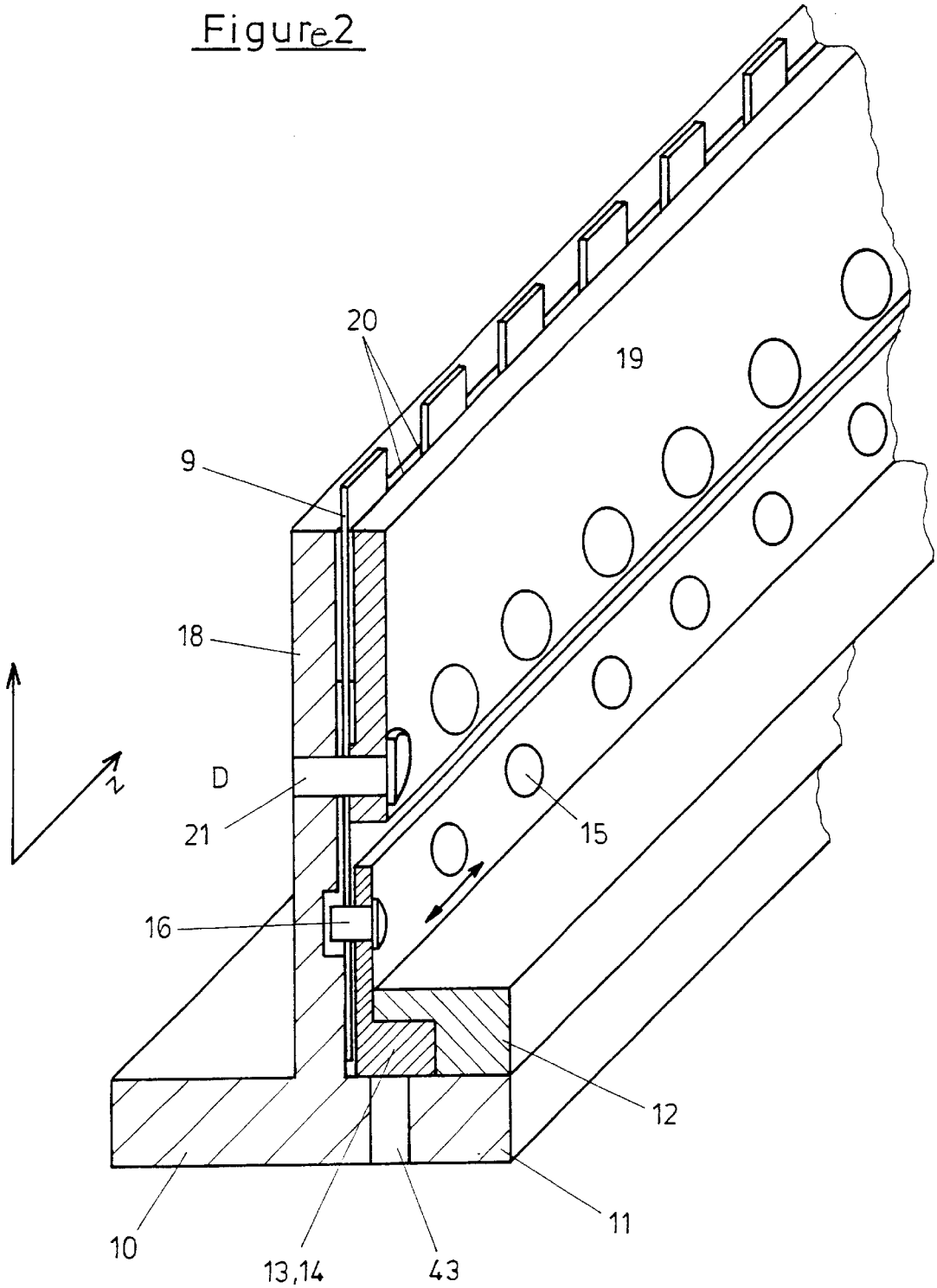
FIG. 2 is a schematic drawing of a cutter with several knives. The cutter containing roller is not illustrated.

The details of the function of the cutter bar are sketched in FIG. 2.

FIG. 2 depicts the cutter bar 8 of the inventive cutter, which has already been shown in FIG. 1. For reasons relating to a better overview, the cutting and transport roller 1, which contains the cutter, the entire holding mechanism of the cutter bar and the pressure cylinder are not shown.

The base element of the cutter bar is a T profile 10, to which various components are attached. A locking plate 12 is mounted on the horizontal overhang 11 of the T profile 10. The carriage 13 of the pull and thrust rod 14 can slide with negligible clearance between the locking plate 12 and the horizontal overhang of the T profile, when it is driven by means of the cones 41 of the pressure cylinder 39 extending through the in the horizontal overhang 11 The cones 41 are not shown in FIG. 2. The pull and thrust rod 14 has boreholes 15, through which the cones 16 reach.

The cones 16 also reach through the oblong holes 17 of the knives 9. The oblong holes are not visible in FIG. 2.

The knives 9 can slide with negligible clearance in the space between the vertical overhang 18 of the T profile 10 and the guide plate 10. In the illustrated embodiment of the invention, the knives 9 are provided with guide beads 20, which can be made, for example, of teflon. The bolts 21 reach through the vertical overhang 18 of the T profile beam 10, the guide plate 19 and the knives 9 and form the point of rotation for the knives 9. The axis of rotation for the knives is labelled D in FIG. 2.

During the cutting process the thrust and pull rod 14 is driven, as stated above, by the pressure cylinder 39. However, the rotational motion of the knives required to carry out the cutting process can also be induced by any other suitable device which provides a force or directly generates a torque. This device can be, among other things, a pneumatic cylinder, an electric linear drive or an electric machine.

During its linear motion the pull and thrust rod 14 moves the cones 16, which reach through the oblong holes 17 of the knives 9 and transfer in this manner transfer the force to the knives 9. Thus, the knives 9 are put into rotational motion. The rotational or swivel motion of the knives 9, depicted in this embodiment, sweeps an angle of significantly less than 360 degrees and may, as shown in the drawings, be less than 180 degrees. The swivel motion of an individual knife 9 is shown in more detail in the FIGS. 3 and 4.

Figure 3:
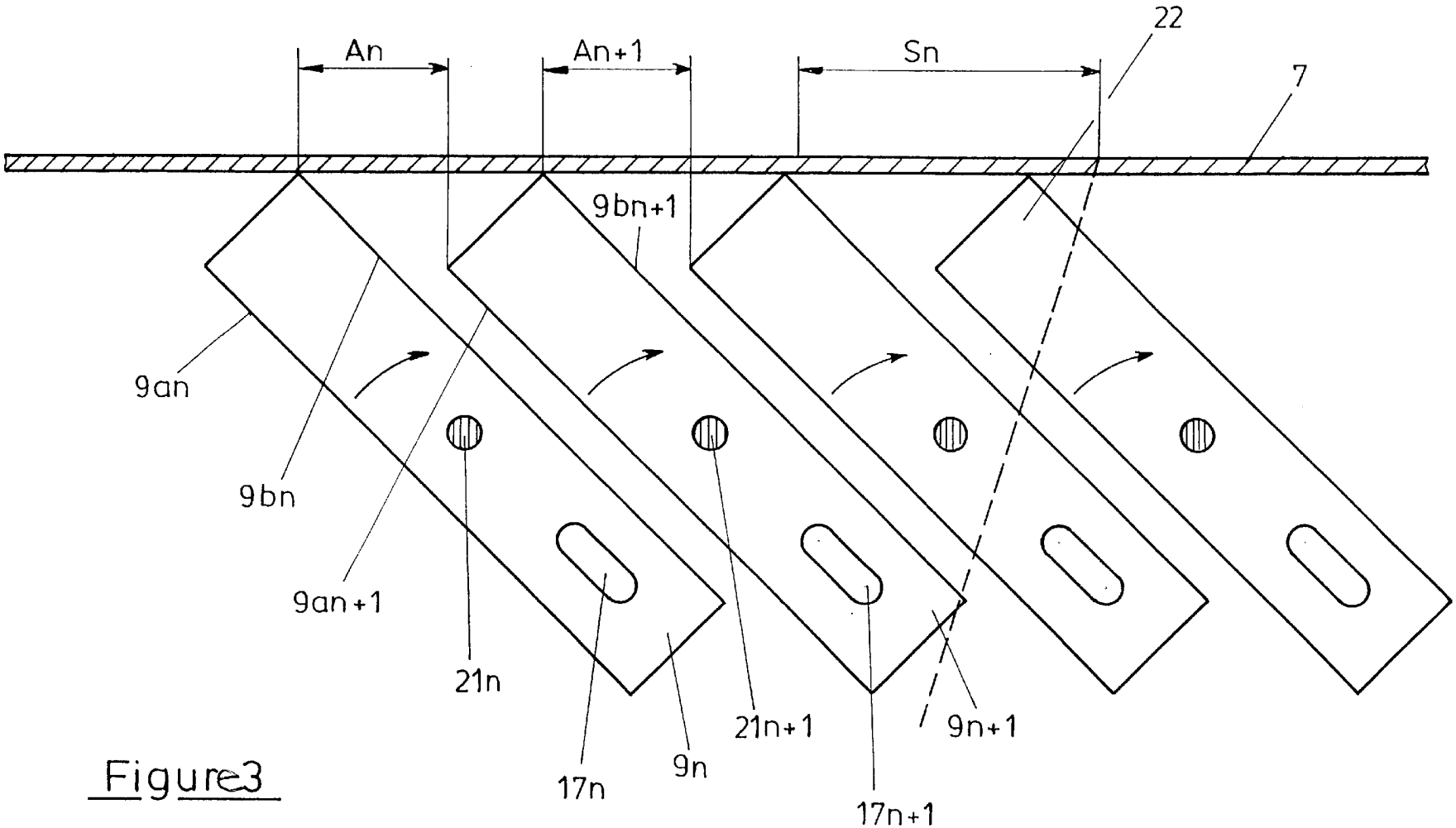
FIG. 3 is a graphical presentation of the cutting motion of several knives.

FIG. 3 is a drawing of a cutting motion of several knives of a cutter. In FIG. 3, the oblong holes 17*n* of the knives 9*n* are also depicted. In this embodiment, the spacing An between the knives 9n is significantly less than the cutting lengths Sn of the respective knives 9*n*. The dashed line 22 indicates the position of the cutting surface 9*n* at the end of the cutting process of the knife 9n. The bolts 21*n* define the point of rotation of the knives 9*n*.

Figure 4:
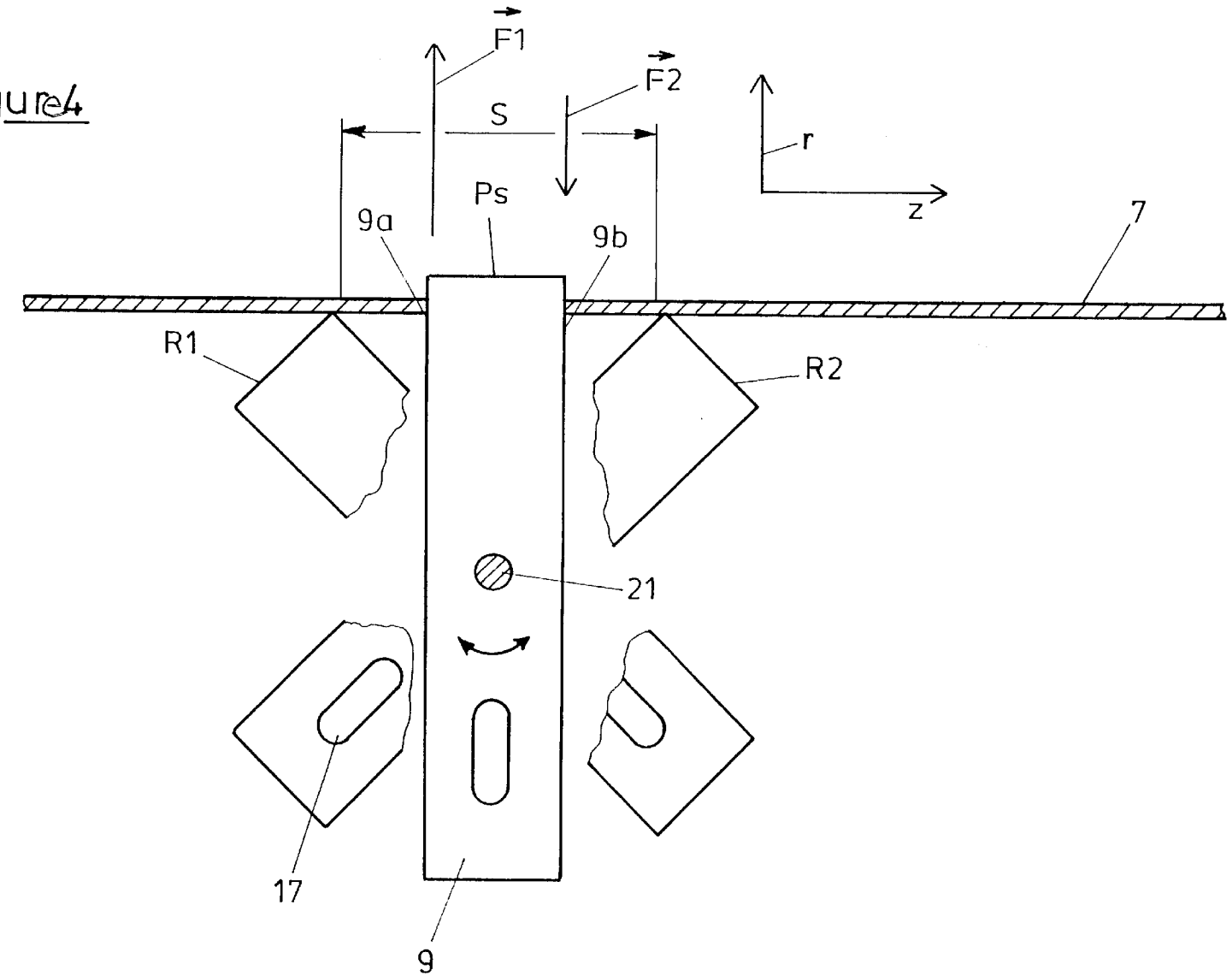
FIG. 4 is a graphical presentation of various phases of the cutting motion of a knife.

FIG. 4 is a sketch, which shows in detail once again the cutting motion of a single knife 9 with the two cutting surfaces 9*a* and 9*b*.

Before the start of the cutting process, the knife is located in the resting position $R_1$. In this position the knife 9 is depicted broken. During the cutting process the knife 9 rotates around the bolt 21. At the start of the cutting process the knife exerts a force $F_1$ on the film, which in the radial direction (r) leads away from the main axis of symmetry of the cutting and transport roller. However, the material web 7 has not been completely severed during this period so that it contributes to the process of forcing the material web against the roller by maintaining the web tension and optionally by partially looping the film around the roller 1. The effect of the force $F_1$ on the film is terminated, when the knife reaches the apex $P_s$ during the cutting process. After passing the apex $P_s$, the knife 9 applies a force effect $F_2$ on the material web that supports the forcing of the material web against the roller 1.

At the end of the cutting process, the knife 9 has introduced a cut having a cut length S into the material web 7. The knife remains in the second resting position R2. Because the knife 9 has a second two cutting surfaces 9*a*, 9*b*, can, therefore, also cut when the cutting process is carried out in the opposite direction.

At the end of the cutting process, the knife 9 has introduced a cut having a cut length S into the material web 7. The knife remains in the second resting position R2. Because the knife 9 has a second two cutting surfaces 9*a*, 9*b*, can, therefore, also cut when the cutting process is carried out in the opposite direction.

Figure 5:
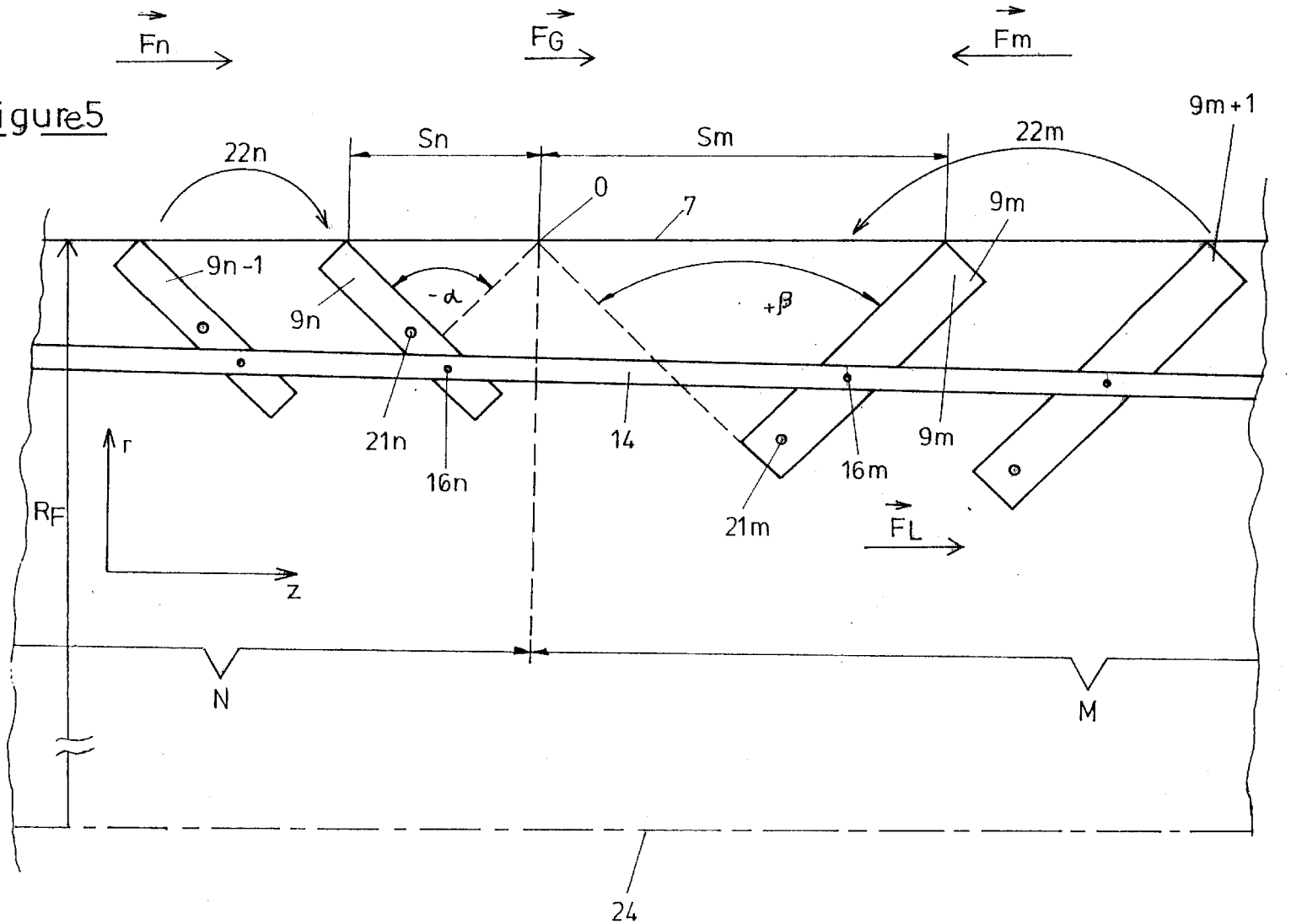
FIG. 5 is a sketch of a cutting process, wherein two groups of knives perform rotational motions in the counterclockwise direction during the cutting process.

In FIG. 5 is a drawing of a cutting process, wherein a first group N of knives 9*n*, 9*n*–1 a rotational motion with negative direction of rotation during the cutting process, whereas a second group of M of knives 9*m*, 9*m*+1, etc. makes a rotational motion with a positive direction of rotation. The knife $9_n$ sweeps an angle-alpha. The different cutting direction of the two groups of knives M and N is shown once again by means of the curved arrows $22_N$ and $22_M$.

In this manner the opposite rotational motion of the knife blades of the two groups N and M results in two forces, whose axial component $F_N$ and $F_M$ act in the opposite direction. Owing to these measures the resulting total force $F_G$, which acts on the film in the axial direction during the cutting process, is reduced.

It is possible to coordinate in such a manner the cutting forces Fn, Fm, which belong to the two groups of knives N, M and which act in the axial direction such that the resulting total force $F_G$ which is exerted on the film in the axial direction, largely disappears.

In the illustrated embodiment, the cut lengths of the knives are coordinated in such a manner that the result is a continuous cut over the entire width of the material web 7. In coordinating the cutting motion of adjacent knives with the cutting motion of a different sense of rotation—in FIG. 5 this description applies to the knives $9_n$ and $9_m$—a collision of the two knives must also be avoided. To this end, it can be provided that the knife 9*m* does not reach the overlap point O until the knife 9*n* has already completed the cutting process and its entire width is located inside the radius of the film reel $R_F$.

FIG. 5 also shows that it is possible with the aid of an individual force, which acts here in the axial direction to generate the opposite rotational motion of both groups of knives N and M.

In the illustrated embodiment, the thrust and pull rod 14 reaches for this purpose with the cone 16*n* underneath the point of rotation 21*n* into the non-illustrated oblong holes 17 of the knives 9*n*, 9*n*–1 of the group N. In this embodiment the pull and thrust rod 14 is running in the axial direction, and thus parallel to the main axis of symmetry 24 of the roller. However, the knives of the groups N and M are made differently. Thus, the bolts 21*n* of the group N are located above the thrust and pull rod 14 whereas the bolts 21*m* of the other group M are disposed below the rod 14. With simple means of this kind the opposite motion of rotation of the two groups of knives N and M can be induced with a single force. Mechanisms which realize the rotational motion of the two groups of knives with the aid of drive units, like an electric machine which provides immediately a torque instead of a force, can be provided with similar simple torque reversing mechanisms. In this manner the opposite motion of rotation of both groups of knives can be induced by one drive unit.

The knives of both groups of knives can also be arranged less uniformly than depicted in the example. Thus, an alternating arrangement of the knives from both groups N and M is also conceivable.

Figure 6:
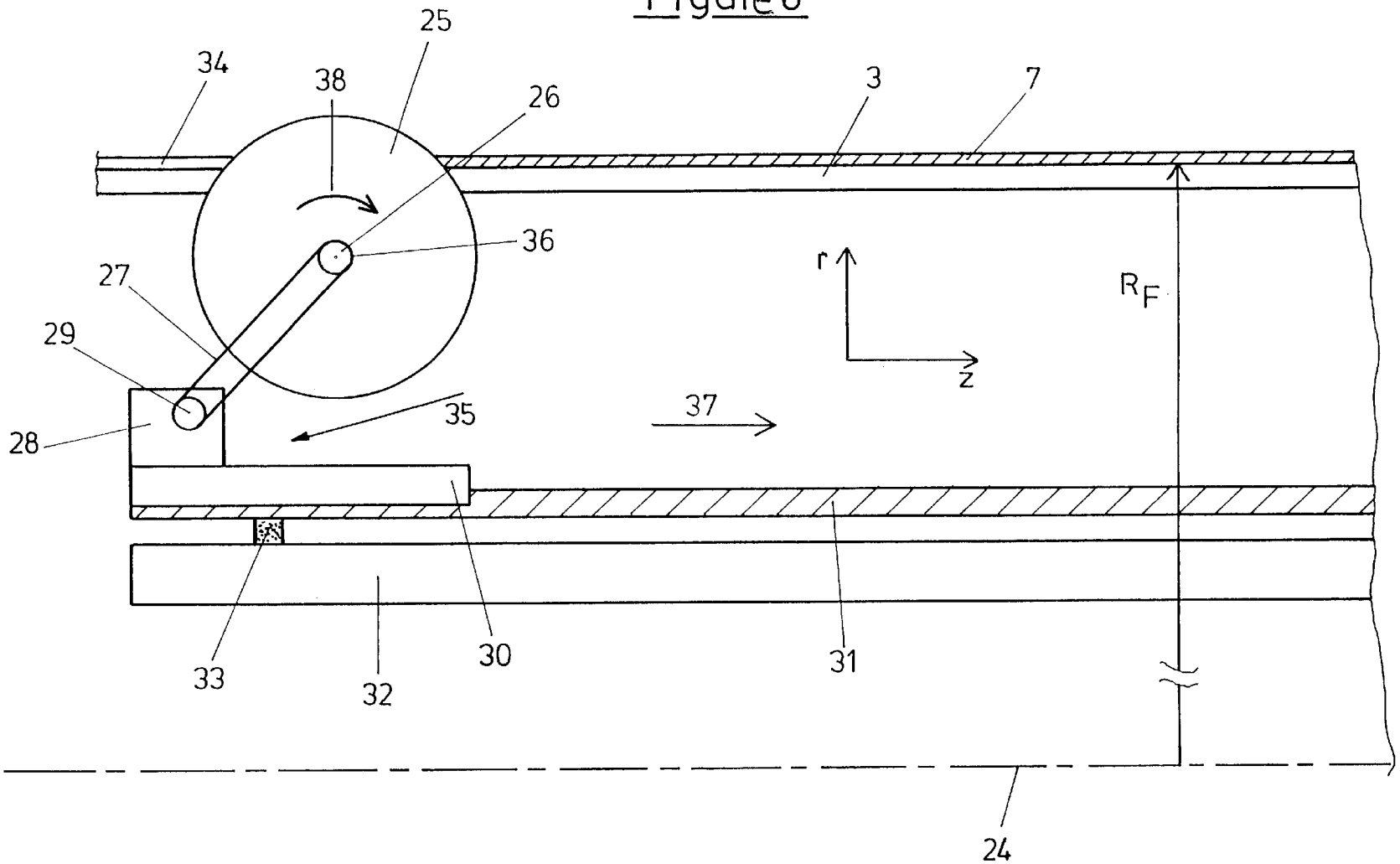
FIG. 6 is a sectional view of a cutting and transport roller, which contains a circular cutter.

FIG. 6 shows another embodiment of the invention with a circular cutter, which has a disk shaped, essentially round knife 25, which severs the film web 7, so that the severed film web 34 can be seen to the left of the round knife 25.

The round knife 25 rotates around the axle 26, which defines thus an axis of rotation 36 that runs perpendicular to the plane, which is defined by the axial (r) and radial (r) coordinates in the reference system of the roller. In this embodiment the rotational direction is shown by means of the curved arrow 38. Since the axis of rotation 36 extends beyond the drawing plane, it can be represented only as a point in FIG. 6.

The torque for the rotational motion is provided by the drive unit 28 and transferred from the shaft 29 over the belt 27 to the axle 26 in the point of rotation 36 of the knife 25.

During the cutting process the entire circular cutter 35 executes a translation in the axial direction (z). In FIG. 6 there is a motion in the direction, depicted by means of the straight arrow 37.

To this end, the circular cutter 35 is mounted on the carriage 30, which slides on the rail 31. The force for this linear motion is provided by the driving mechanism 32, which transfers said force with the cone 33 to the carriage 30.

It must also be noted that the cutting process, shown in FIG. 6, can begin in different ways. Thus, the knife 25 can make contact with the material web 7 by means of a motion of the circular cutter 35 in the axial direction. This is possible especially when the width of the material web 7 is less than the maximum working width of the knife 25, which is defined by the length of the travel path of the carriage 30 and the length of the knife slit 6 in the shell 3 of the roller 1.

However, it is also possible for the knife 25 to make contact with the material web 7 by moving in the radial direction at the start of the cutting process. To this end, the carriage 30 can exhibit, for example, a lifting device, which can move the circular cutter in the radial direction (r).

In this respect it must be emphasized once again that it would be advantageous for all of the illustrated embodiments of the invention if the cutting motion were also supported with translatory components in the radial direction. To this end, a suitable lifting device can be provided in the radial direction below the cutter bar 8. Some of the claims below also disclose advantageous embodiments of devices and processes of this kind.

Figure 7:
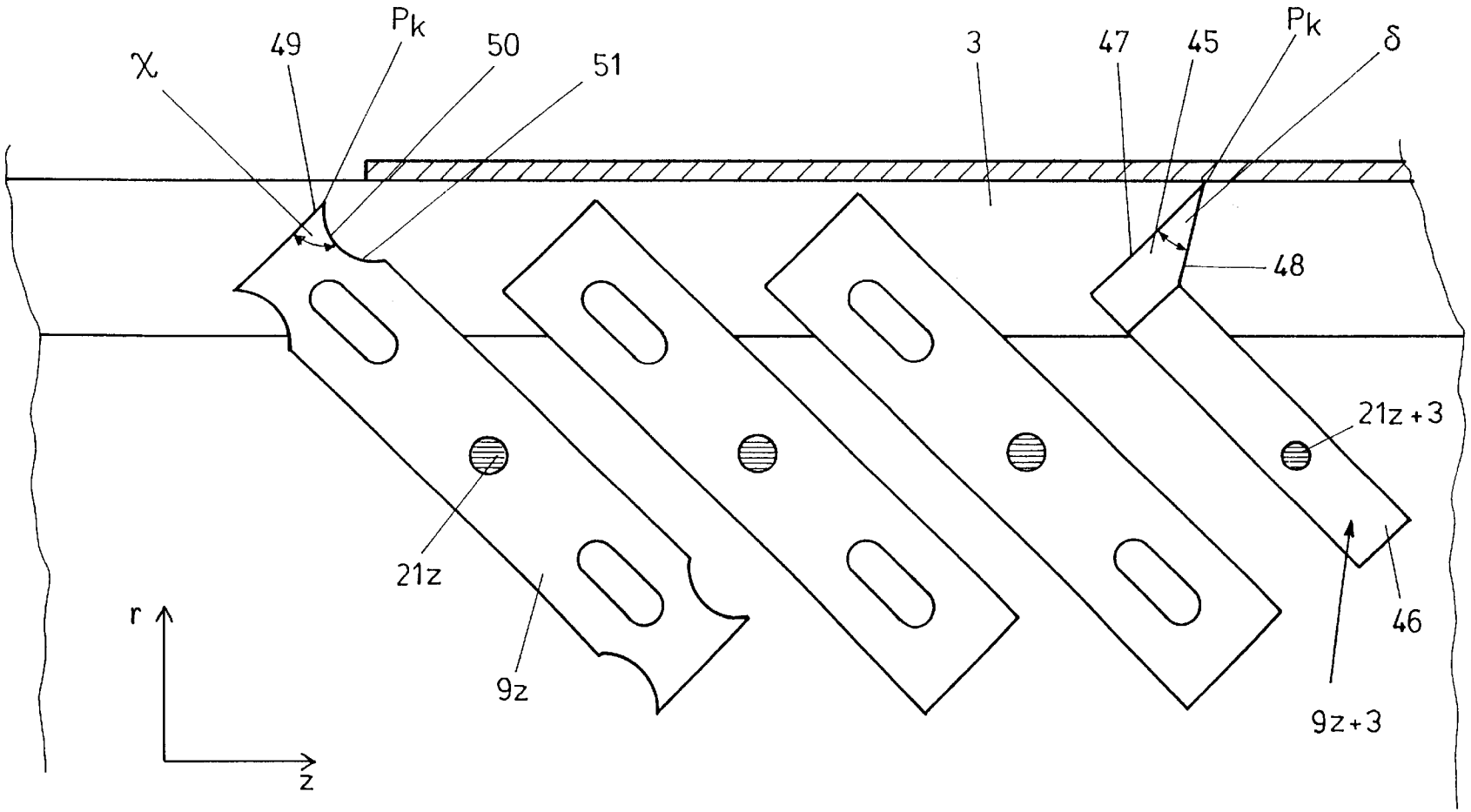
FIG. 7 is a sketch of several knives with exemplary shaped cutting blades, which further facilitate the cutting process.

FIG. 7 is a drawing of several knives with exemplary shaped cutting blades, which further improve the cutting process.

To this end, knives are used that exhibit special shapes of these knives directly at the contact point $P_K$, where the knives $9_z$ and $9_{z+3}$ make contact with the material web 7 for the first time. Thus, the knife 9z has a semicircular recess 51 in the area of its cutting blade directly below the point $P_k$. The presence of this semicircular recess 51 results in an $angle_x$ between the upper area of the cutting edge 50 of the knife $9_z$ and the edge 49, which is less than 90 degrees. In this manner a force component is generated in the radial direction (r) during the cutting process of the knife $9_z$, before the knife reaches the apex of the cutting motion $P_s$, shown in FIG. 4. In any event with these measures the force effect of the knife on the web is changed in an advantageous manner.

The knife $9_{z+3}$ consists of two parts 45 and 46. The part 45 is wedge shaped and shaped in such a manner that between the cutting edge 48 and the edge 47 there is an angle delta, which is also less than 90 degrees.

Both the knife $9_z$ and the knife $9_{z+3}$ are only exemplary shapes of knives that have edges, whose angle is less than 90 degrees and which provide the aforementioned force effect during an early phase of the cutting process, in the immediate vicinity of the point $P_K$. Especially advantageous is the use of knives of the described type on the edge of the material web 7, resting on the shell 3. However, the use of knives of the described kind for severing the material web 7 over its entire width can also be advantageous.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A cutting and transport roller, comprising:

an outer shell, provided with a slotted opening;

a cutter for severing a material web which rests on the shell of the transport roller, said cutter contained within said outer shell in a resting position and containing at least one knife which is guided by a cutter holder and which includes at least one cutting edge, said at least one knife being hinged to the cutter holder so as to swivel while extending through the opening in the shell to thereby cut the material web;

said swivelable coupling of said at least one knife defining for said at least one cutting edge an axis of rotation, which runs either parallel or at an acute angle to a line that is perpendicular to a plane which is defined by radial (r) and axial (z) coordinates of the cutting and transport roller.

2. The cutting and transport roller, as claimed in claim 1, wherein said at least one knife is attached to a cutter bar, which can execute a translational motion in a radial and/or axial direction of the cutting and transport roller.

3. The cutting and transport roller, as claimed in claim 2, wherein attached to the cutter bar is a circular cutter having a disk shaped, essentially round knife put into rotational motion with an electric motor.

4. The cutting and transport roller, a claimed in claim 1, further comprising a device attached inside the shell of the cutting and transport cylinder which provides and transfers a force to a pull and thrust rod which is hinged to said at least one knife and is offset in the radial direction of the cutting and transport roller relative to the axis of rotation of said at least one knife.

5. The cutting and transport roller, as claimed in claim 4, wherein attached to the pull and thrust rod are cones which extend through oblong holes in said at least one knife for driving the knife.

6. The cutting and transport roller, as claimed in claim 4, wherein the pull and thrust rod is designed as a carriage which runs between guide elements of the cutter.

7. The cutting and transport roller, as claimed in claim 1, wherein said at least one knife is made of a flat sheet metal-like material, a thickness of which is small compared to a width of the knife.

8. The cutting and transport roller, as claimed in claim 1, wherein the cutter contains a plurality of knives whose cutting blades in the resting position have a spacing therebetween which is less than or equal to a length of the cut which each knife introduces into the material web.

9. The cutting and transport roller, as claimed in claim 1, wherein the cutter contains a plurality of knives which are hinged to points of rotation and are positioned so as to be offset in the radial direction of the roller.

10. The cutting and transport roller, as claimed in claim 1, wherein said cutter includes a plurality of knives each of which is hingedly connected to a pull and thrust rod for initiating rotational movement of said knives.

11. The cutting and transport roller, as claimed in claim 10, wherein at least a first knife within said plurality of knives rotates in a first direction when executing a cutting motion, and at least a second knife within said plurality of knives rotates in a second direction when executing a cutting motion, the second direction being opposite the first direction, both cutting motions being initiated concurrently by movement of said pull and thrust rod in a single direction.

12. The cutting and transport roller, as claimed in claim 11, wherein said first knife of the first group is coupled to said pull and thrust rod at a point in the radial direction below said first knife axis of rotation, and said second knife of the second group is coupled to said pull and thrust rod in the radial direction at a point above said second knife axis of rotation.

13. The cutting and transport roller, as claimed in claim 10, wherein a first group of knives within said plurality of knives rotates in a first direction when executing a cutting motion, and a second group of knives within said plurality of knives rotates in a second direction when executing a cutting motion, the second direction being opposite the first direction, both cutting motions being initiated concurrently by movement of said pull and thrust rod in a single direction.

14. The cutting and transport roller, as claimed in claim 13, wherein said first group of knives is coupled to said pull and thrust rod at a point in the radial direction below an axis of rotation of each of said first group of knives, and said second group of knives is coupled to said pull and thrust rod in the radial direction at a point above an axis of rotation of each of said second group of knives.

* * * * *